US007177235B2

(12) United States Patent
Rund

(10) Patent No.: US 7,177,235 B2
(45) Date of Patent: Feb. 13, 2007

(54) TIMER WITH SELECTABLE ALERT MODES

(75) Inventor: Richard Rund, Great Falls, VA (US)

(73) Assignee: F.O.B. Instruments, Ltd, Wanchai (HK)

( * ) Notice: Subject to any disclaimer, the term of this patent is extended or adjusted under 35 U.S.C. 154(b) by 286 days.

(21) Appl. No.: 10/373,967

(22) Filed: Feb. 27, 2003

(65) Prior Publication Data

US 2004/0170089 A1 Sep. 2, 2004

(51) Int. Cl.
*G04B 19/00* (2006.01)
*G04B 23/00* (2006.01)
*G04B 25/00* (2006.01)

(52) U.S. Cl. ..... 368/261; 368/244; 368/250

(58) Field of Classification Search ..... 368/89, 368/97–99, 107–112, 203–205, 259–261, 368/243, 249, 250, 276, 244
See application file for complete search history.

(56) References Cited

U.S. PATENT DOCUMENTS 4,365,238 A 12/1982 Kollin
4,490,711 A * 12/1984 Johnston ..... 340/309.4
4,545,686 A * 10/1985 Ushikoshi ..... 368/63
4,872,005 A 10/1989 DeLuca et al.
4,894,649 A 1/1990 Davis
5,020,037 A * 5/1991 Raven ..... 368/10
5,089,998 A 2/1992 Rund
5,288,233 A 2/1994 Green
5,289,157 A * 2/1994 Rudick et al. ..... 340/309.7
5,400,301 A * 3/1995 Rackley ..... 368/72
5,590,944 A * 1/1997 Stokes ..... 353/122
5,666,331 A * 9/1997 Kollin ..... 368/245
5,908,301 A 6/1999 Lutz
5,990,782 A * 11/1999 Lee ..... 340/309.7
6,042,383 A 3/2000 Herron
6,301,196 B1 * 10/2001 Daniel ..... 368/10
6,549,179 B2 * 4/2003 Youngquist et al. ..... 345/39
6,565,253 B1 * 5/2003 Yang ..... 368/294
6,724,298 B2 * 4/2004 Smith ..... 340/407.1

FOREIGN PATENT DOCUMENTS

GB 2 205 665 A 12/1988

* cited by examiner

*Primary Examiner*—Vit Miska
*Assistant Examiner*—Jeanne-Marguerite Goodwin
(74) *Attorney, Agent, or Firm*—Cahn & Samuels, LLP.

(57) ABSTRACT

A multi mode alert timer having a timer display, switches for start stop and reset functions and audible, visible, and tactile alert signal selection and a housing where a user may select a timer alert signal including the individual alert signals or any combination thereof.

21 Claims, 3 Drawing Sheets

FIG 1.
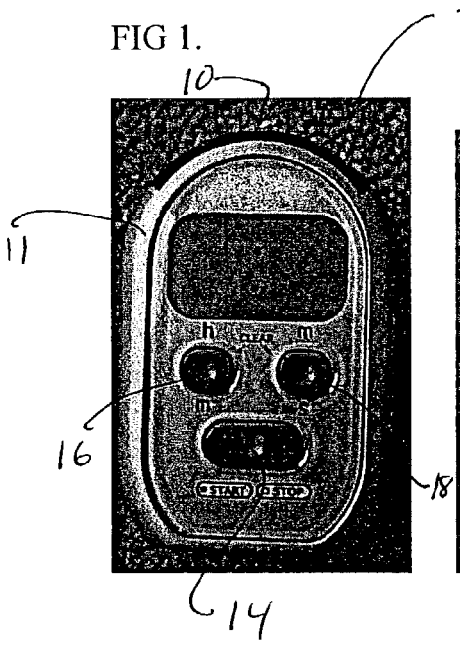
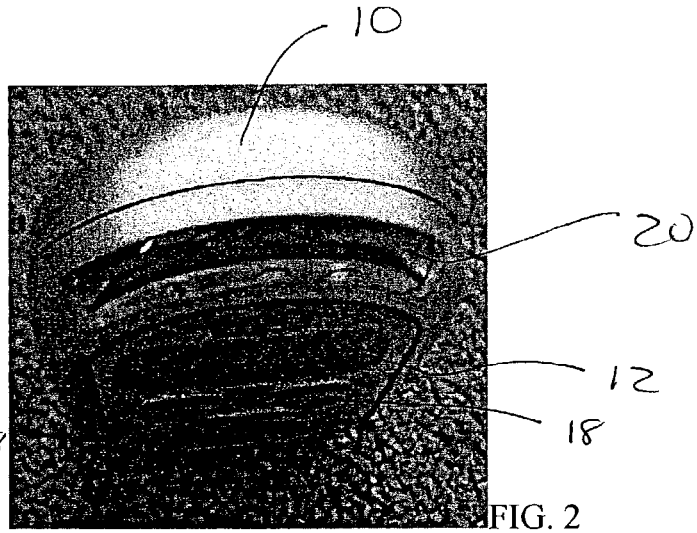
FIG. 2
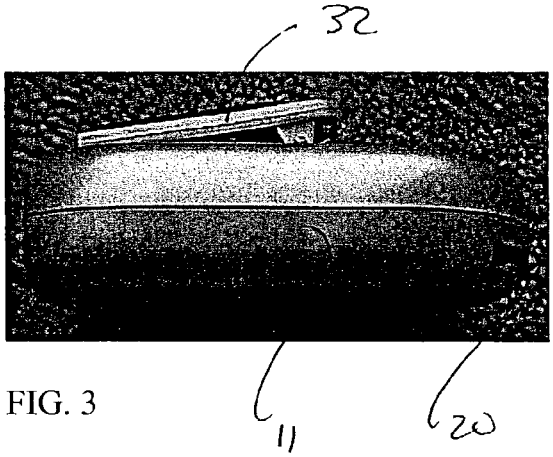
FIG. 3
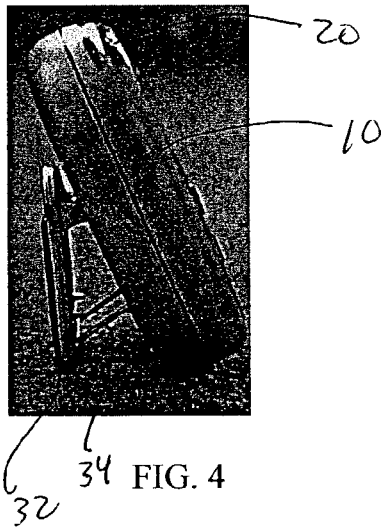
FIG. 4

TIMER WITH SELECTABLE ALERT MODES

I. FIELD OF THE INVENTION

This invention relates to timers, clocks, and alerting devices particularly for use in the behavioral training and special education fields, for use by persons with auditory disabilities, and for use by persons in loud and dark environments or where use of an audible alert may not be appropriate. The invention includes a timer/clock combined with vibratory, audible, and visual indicators.

II. TECHNICAL BACKGROUND AND DESCRIPTION OF RELATED ART

Persons and particularly children, suffering from PDD (pervasive development disorder) such as autism and Aspergers syndrome as well as those experiencing ADD (attention deficit disorder) and ADHD (attention deficit hyperactivity disorder exhibit a spectrum of adverse behavioral and learning deficiencies. Commonly such deficiencies involve slowed development of basic psychological functions, manifestations of unacceptable social skills (e.g., aggression), language and communication deficiencies, and difficulties in motor movement. The disorders which display signs of developmentally inappropriate inattention, impulsivity and hyperactivity are symptoms commonly associated with ADD and/or ADHD. Current educational criteria require children suffering from the above to obtain medical attention, where they are prescribed condition-appropriate pharmaceuticals. Also special educational programs involve formal behavior training, typically behavior modification in an attempt to curb impulsivity, distractibility, and other disturbances of language and/or social behavior. Such programs are intended to enhance behavioral, communication, and organizational skills with the object, where possible, of mainstreaming.

Examples of timing/scheduling adjuncts for use in behavioral modification program adjuncts are disclosed in U.S. Pat. Nos. 5,288,233, 6,042,383, and 5,908,301 respectively a wall-mounted, animated timer reward-based game, a portable task reward, programmed timer, and a programmable diet/smoking cessation adjunct with timers and alerts.

One widely acclaimed regimen for implementing a behavioral modification program for persons suffering from the foregoing syndromes and problems is based on timers. The "1-2-3 Magic" program developed by Dr. Thomas W. Phelan is a method for managing and treating behavioral problems employing a prescribed sequence of educator/caregiver reaction to undesirable and/or unacceptable behaviors. In this program, a child is given a series of two warnings before a pre-established "quiet" period ("time out") is enforced. Such time out is predetermined in both duration and location. For smaller children the duration may be for two minutes in a special chair dedicated to time out. Timers are commonly used for the child to monitor the time out countdown. Where the child exhibits prohibited or non-compliant behavior during the timeout period, the educator/caregiver restarts the timer for the prescribed period. The child is excused from time out only after the period expires and the child has complied, i.e., not exhibited any adverse behaviors.

It has been observed that during the timeout period, children often focus on the timer and the time remaining. Most commonly, the timing device provides an audible alarm when time expires. However, some children are more attuned to visual stimuli and some may even exhibit phonophobia, an aversion to sudden and load sounds, e.g., an alarm clock bell. For this reason, it would be desirable to combine audible and visual alert indicators or selectively, a visual alert indicator to advise the child that the time out period is over.

In the case of a person with substantially impaired hearing or deafness, an audible timer alarm is effective only when coupled with another alert adjunct such as vibratory and/or visual indication.

Over the years many alarm clock/alert/timer devices have been devised for use by the deaf. For example, U.S. Pat. No. 4,365,238 describes a multi-station visual signaling system for alerting a deaf person of a particular event (incoming telephone communication, clock alarm functions, etc. Your inventor herein obtained U.S. Pat. No. 5,089,998 (hereafter the '998 patent) for a combination Vibrating and Audible Alarm Clock for use by persons who are hard-of-hearing or for persons in environments in which it is hard to hear (loud). The teachings of that patent are incorporated herein by reference.

III. SUMMARY OF THE INVENTION

It is, therefore, an object of the present invention to address and overcome shortcomings of prior art timing devices.

Another object of this invention is to provide timing devices capable of multi or single mode alerting.

A more particular object of the invention provides a timer adjunct for use in special education situations.

Still another object of this invention is to provide a timer capable of any or all of audible, visible, and tactile/vibratory alerts indicating the expiration of a preset period.

Yet another object of this invention is to provide a rugged, portable timer device adapted for use with special needs children or adults.

Another object of this invention is to provide a useful adjunct for behavior modification training.

It is another object of this invention to provide a single device that may be used for a plurality of select functions contingent on the needs of a particular student/trainee in a special education environment.

A further object of this invention is to provide a timer with an array of readily visible light emitters of selected colors.

These and other objects are satisfied by a timer comprising: a durable housing; electronic timer disposed in said housing, said electronic timer including time period set and reset, an alert mode selector including visible, audible and tactile alert indicators, where the selector permits user selection of at least of one said visible, audible, or tactile alert indicators; timer indicator signal generator; alert signal generator generating at least one alert signal responsive to said timer indicator signal and the selector; alert off signal input comprising a clear or reset button, wherein the reception of an alert off signal disables the generation of the alert signal; power source disposed in said housing and connected to said electronic timer and said alert signal generator for supplying power to said electronic timer, said alert signal generator, and said visible, audible and tactile alert indicators; a time display mounted in the face of said housing and connected to said electronic timer; sound generating means disposed in said housing for generating an audible alert indicator when said sound generating means is activated by said; vibration generating means mounted within said housing for generating a tactile alert indicator; visible indicator generating means mounted in relation to said housing so as to be visible from the exterior of said housing; user accessible alert mode selection switch for selectively switching between one or more of said sound generating means, said vibration generating means, and said visible indicator generating means and combinations thereof.

Still other objects are satisfied by a user selectable timer alert indicating timing method using a timer with selectively activatable audible, visible, and tactile alert modes and a timer activation and deactivation button including the steps of: selectively activating at least one of the audible alert mode, the visible alert mode or the tactile alert mode; setting the timer to a select duration; and actuating the timer whereupon expiration of the select duration, the selectively actuated alert mode will be activated.

The invention contemplates both apparatus dedicated to its employ and converting existing structures using off-the-shelf basic components already available to electronics industry.

As used herein "connected" includes physical, whether direct or indirect, permanently affixed or adjustably mounted, as for example, a bar of light emitting diodes may be mounted integrally within the time case, mechanically, e.g., pivotally, or electronically, e.g. wireless, if detachable. Thus, unless specified, "connected" is intended to embrace any operationally functional connection.

As used herein "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

In the following description, reference is made to the accompanying drawing, and which is shown by way of illustration to the specific embodiments in which the invention may be practiced. The following illustrated embodiments are described in sufficient detail to enable those skilled in the art to practice the invention. It is to be understood that other embodiments may be utilized and that structural changes based on presently known structural and/or functional equivalents may be made without departing from the scope of the invention.

IV. BRIEF DESCRIPTION OF THE DRAWINGS

FIG. 1 is a front view of the illustrated embodiment of the timer of the present invention.

FIG. 2 is a top perspective view of the illustrated embodiment.

FIG. 3 is a side view of the illustrated embodiment.

FIG. 4 is a side view of the illustrated embodiment in the upright position.

V. DETAILED DESCRIPTION OF THE INVENTION

Figure 5:
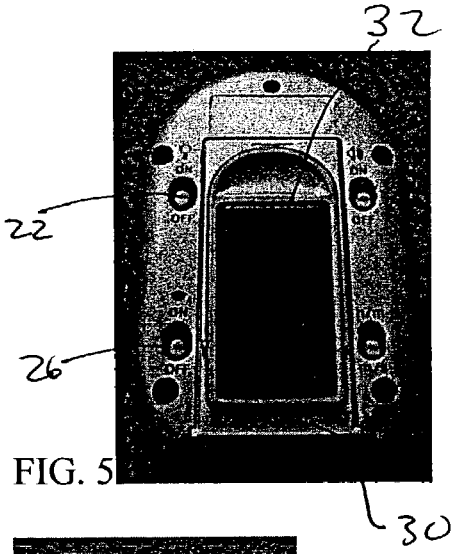
FIG. 5 is a back view of the illustrated embodiment.
Figure 6:
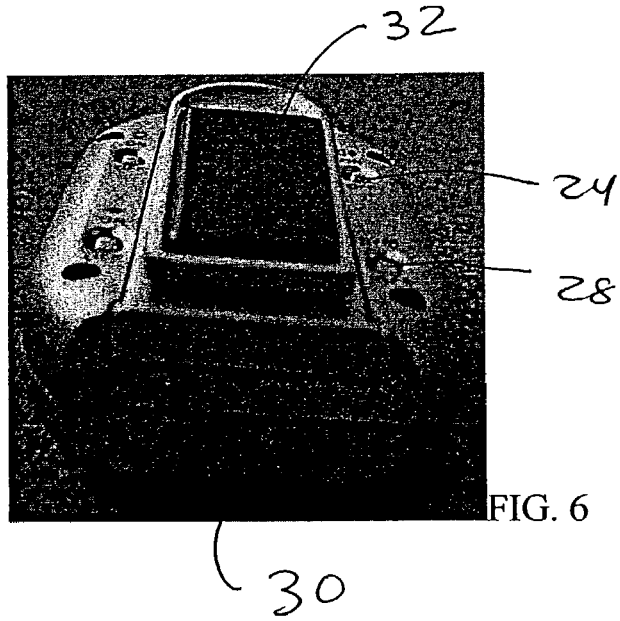
FIG. 6 is a perspective rear view of the illustrated embodiment.

The subject invention is illustrated in the attached drawings which are referred to herein. Throughout the drawings and the description below the same reference numeral will be used to identify identical elements.

With reference to FIGS. 1–7, numeral 10 designates the complete timer assembly of the illustrated embodiment. The timer 10 comprises a housing 11 formed from a rugged plastic, such as ABS plastic, or may be constructed of a softer rubberier housing to prevent injury should the timer be used as a projectile by a special needs student. To facilitate portability, the dimensions of the illustrated timer 10 is roughly 2¾ inches by 1¾ inch by ¾ inch (height, width and depth).

In addition a recessed timer face 12 (preferably a lower energy consuming LCD or its equivalent), the front of the timer 10, includes a start-stop switch 14, an hour-minute set switch 16 and a minute-second set switch 18. The set switches 16 and 18 also function as clear switches to reset the timer. Arcing across the top of the timer 10 is an array of LEDs (light emitting diodes) 20 for flashing when time expires. To facilitate use of the timer in low light situations, the buttons may be illuminated and the timer face may include a light source (not illustrated) to permit the LCD to be read easily. As in the '998 patent, to facilitate reading the timer in the dark the light source may be in the form of two small light bulbs connected in series from ground to one side of a timer face light switch described below where the bulbs are mounted on the printed circuit board so as to be positioned on either side of the LCD timer face 12.

The back of the timer 10 includes four toggle switches 22, 24, 26, and 28. The toggle switch 22 selectively activates or deactivates the LED array 20 for providing the visible indicator of the alarm function. The toggle switch 24 selectively activates and deactivates the audible timer alarm. The toggle switch 26 selectively activates or deactivates the vibration indicator for the alarm function and toggle switch 28 permits selection between the hour-minute and minute-second mode of operation. The back of the timer 10 also features a slidably lockable battery compartment cover 30 on which is pivotally mounted a clip stand 32. The clip stand permits the user to either clip the timer 10 to a selected structure (e.g. belt) or to provide a convenient self-contained flip-out stand. The stand is established by pivoting the clip 32 which is spring bias in the closed position, a sufficient distance to permit pivotal U-shaped element 34 to extend horizontally where the clip 32 is retained in a triangulated position (See FIG. 4). Thus, the timer 10 can be positioned on a generally flat surface in a generally upright or vertical position where the timer is easily viewed.

Figure 7:
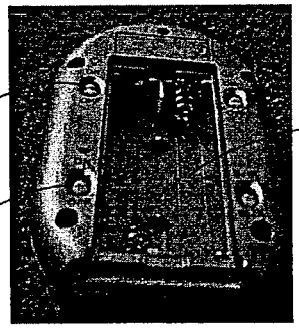
FIG. 7 is a rear view of the illustrated embodiment with an open battery compartment.

As illustrated in FIG. 7, removing the cover 30 exposes the underlying battery compartment 36 which, as illustrated is dimensioned to receive and retain two AAA batteries as the timer power source. In lieu of conventional battery power, other conventional power sources may be incorporated with the timer such as ac power, photovoltaic cells, etc. However, for portable use in unlighted or dark environments, use of conventional battery power is preferred.

Figure 8:
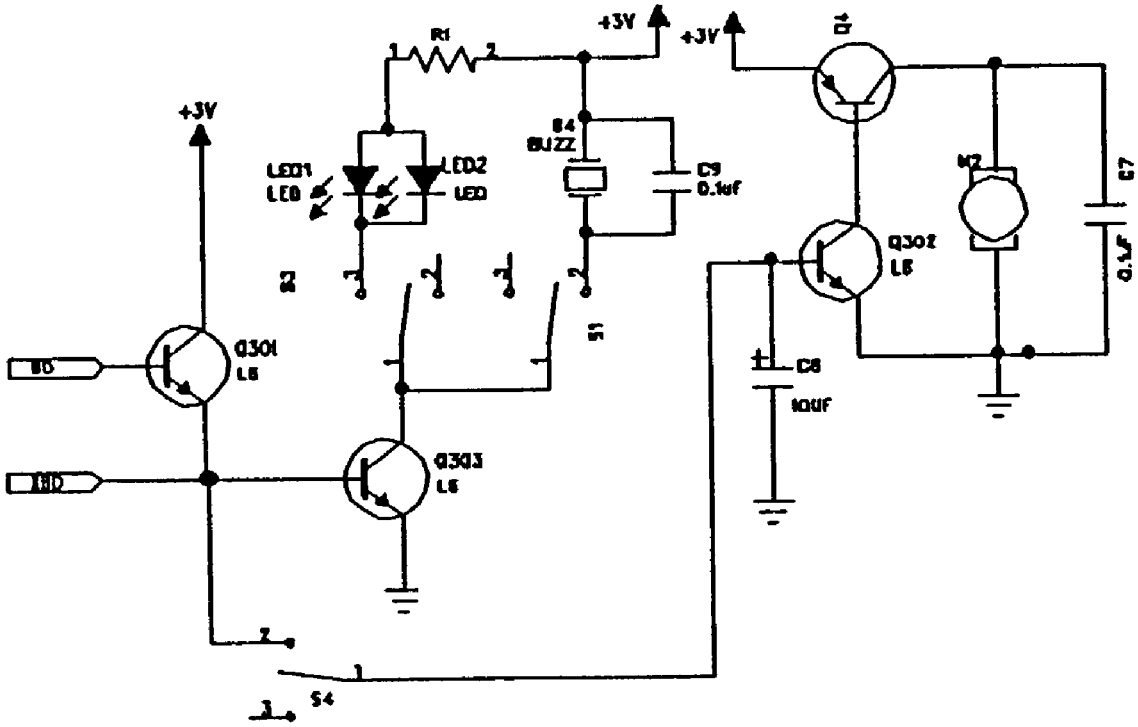
FIG. 8 is a schematic diagram of the circuitry of the present invention.

FIG. 8 illustrates schematically the electronic circuitry of the illustrated embodiment of the present invention. In the illustrated embodiment, the chip used for this invention is the MYSON MTU 410. All of the functional features of the invention are connected directly or indirectly to the chip which is mounted on a printed circuit board (not illustrated). These features include the LCD display 12, the companion lights for the LCD, the vibratory motor, an audible alarm speaker, the visible LED array 20, the user settable switches 14, 16,18, 22, 24, 26, and 28, and the power source.

In one variation of the timer invention, it may also include a conventional electronic clock device (e.g. digital, quartz, etc.) of the type described in the '998 patent. In such a case, it would be preferable to include additional switches for clock set and alarm functions. Such a combination is within the ordinary skill in the art.

In actual use for behavioral modification, a teacher/trainer selects the duration of a time out (3 minutes, 6 minutes, etc. depending on the age of the child or the severity of the infraction). The teacher can also set the mode of alert signaling by actuating a user alert selector that scrolls between a variety of signal alert modes. For example, where all three alert modes are desired, the user manipulates each of the three selectors corresponding to each of the three alert modes to actuate that associated mode, and, if applicable, actuate a particular form or feature of that mode which may be indicated by an icon on the display. When the set time expires—the timer reaches zero—the timer generates alert signals corresponding to all three of the selected alert modes. Such a combination of stimuli is difficult to overlook even by a distracted special needs student. Where the circumstances do not require that the student be exposed to one or more of the alert modes, e.g., tactile/vibratory where remote, visual in bright sunlight, or audible in a loud environment, the teacher may unselect one or more of the alert modes. In this manner, particularly where the power source is a battery, energy consumption can be reduced by exercise of such selectivity.

In a further embodiment of the invention, the visible portion may include diodes exhibiting different colors that may or may not correspond to a particular stage of the timing progression. For example, a timer may exhibit a red light up to the minute before the pre-selected period ends whereupon it may exhibit a yellow light for the final minute and a flashing green light corresponding to the end of the period.

The above-described timer incorporating selectable, visible, auditory and tactile alert/alarm functions can also be solar powered and may incorporate conventional clock and alarm clock functions. It will be understood that various other changes of the details, materials, steps, arrangements of parts, and uses, which have been herein described and illustrated in order to explain the nature of the invention, will occur to and may be made by those skilled in the art, upon a reading of this disclosure, and such changes are intended to be included within the principles and scope of this invention.

Variations of the above-described apparatus and methods are intended to fall within the scope and spirit of the invention. For example, the sound generator may include a conventional IC technology for generation of a variety of user selectable sounds (nature, water, animals, circus sounds, etc.) The timer may incorporate a controller for the light display which may include small fluorescent tubes, diodes, or even more powerful/brighter emitters so that the user (teacher/trainer) may set the visual indicator to the most effective visual alert pattern for a particular student/trainee (solid, flashing, multicolored, alternating color or a combination thereof). It may also be desirable to provide a projecting indication such as laser light patterns or a smiley face where it would be beneficial for the visual component to be pivotally mounted on the timer housing so the teacher trainer could align the projected image on a selected surface. Also, the visible element of the inventive timer may include a separable light emitting section. In such an adaptation, the timer may be placed at a location that permit communication of the alert signal from the main housing via an appropriate wireless linkage (e.g., RF, IR) but is separated from the timer body.

Given the foregoing, it should be apparent that the specifically described embodiments are illustrative and not intended to be limiting. Furthermore, variations and modifications to the invention should now be apparent to a person having ordinary skill in the art. These variations and modifications are intended to fall within the scope and spirit of the invention as defined by the following claims.

I claim:

1. A portable timing device comprising:

a housing;

a display disposed within said housing;

a timing unit disposed within said housing that generates a trigger signal;

a light source disposed within said housing so as to be visible from an exterior of said housing;

a sound generator disposed within said housing;

a vibration generator disposed within said housing;

a user actuatable alert mode selection switch unit for selectively activating and deactivating each combination of one or more of said light source, said sound generator and said vibration generator;

wherein, responsive to the time signal and when activated, said sound generator produces an audible alarm, said tight source produces a visible alarm and said vibration generator produces a vibratory alarm.

2. The portable timing device of claim 1 wherein said light source forms an arc proximate to a top portion of said housing.

3. The portable timing device of claim 2 wherein said light source includes an array of light emitting diodes.

4. The portable timing device of claim 1 wherein the visible alarm includes flashing said light source.

5. The portable timing device of claim 1 wherein said timing unit includes a timer circuit.

6. The portable timing device of claim 1 further comprising a start-stop switch for initiating and stopping a time count and a mode selection switch for selectively displaying the time count in units of hours-minutes or minutes-seconds.

7. The portable timing device of claim 6 further comprising a clip stand attached to the housing.

8. The portable timing device of claim 6 further comprising a battery compartment.

9. The portable timing device of claim 6 wherein said housing has a height of about 3 inches, a width of about 2 inches and a depth of about 1 inch.

10. The portable timing device of claim 1 wherein said light source includes an army of light emitting diodes of different colors.

11. The portable timing device of claim 1 further comprising a controller for selecting a pattern for said visible alarm.

12. The portable timing device of claim 11 wherein the visual alarm includes one of a solid light, a flashing light, a multicolored light, and an alternating color light.

13. The portable timing device of claim 1 wherein the timing device is a timer.

14. The portable timing device of claim 1 wherein the timing device is a clock.

15. A portable timing device comprising:

a housing;

a display disposed within said housing;

a timing unit disposed within said housing that generates a trigger signal;

a light source pivotally mounted on said housing;

a sound generator disposed within said housing;

a vibration generator disposed within said housing;

a user actuatable alert mode selection switch unit for selectively activating and deactivating each combination of one or more of said light source, said sound generator and said vibration generator;

wherein, responsive to the time signal and when activated, said sound generator produces en audible alarm, said light source produces a visible alarm and said vibration generator produces a vibratory alarm.

16. The portable timing device of claim 15 wherein the visible alarm includes a light pattern.

17. The portable timing device of claim 15 wherein the visible alarm includes a projection.

18. The portable timing device of claim 17 wherein the projection includes a smiley face.

19. The portable timing device of claim 15 wherein the timing device is a timer.

20. The portable timing device of claim 15 wherein the timing device is a clock.

21. A portable timing device comprising:

a housing;

a display disposed within said housing;

a timing unit disposed within said housing that generates a trigger signal;

a light source disposed within said housing so as to be visible from an exterior of said housing;

a sound generator disposed within said housing;

a vibration generator disposed within said housing;

means for selectively activating and deactivating each combination of one or more of said light source, said sound generator and said vibration generator wherein, responsive to the time signal and when activated, said sound generator produces an audible alarm, said light source produces a visible alarm and said vibration generator produces a vibratory alarm.

* * * * *